United States Patent [19]

Brennesholtz

[11] Patent Number: 4,770,962

[45] Date of Patent: Sep. 13, 1988

[54] MONOCHROME CATHODE RAY TUBE FOR USE AS A COLOR REFERENCE

[75] Inventor: Matthew S. Brennesholtz, Waterloo, N.Y.

[73] Assignee: North American Philips Corporation, New York, N.Y.

[21] Appl. No.: 839,401

[22] Filed: Mar. 14, 1986

Related U.S. Application Data

[62] Division of Ser. No. 719,616, Apr. 3, 1985, Pat. No. 4,607,188.

[51] Int. Cl.[4] ..... G03C 5/00

[52] U.S. Cl. ..... 430/24; 430/25; 430/26; 313/470; 427/68

[58] Field of Search ..... 430/25, 26, 24, 394; 427/68; 354/1; 313/102, 470

[56] References Cited

U.S. PATENT DOCUMENTS 3,890,151 6/1975 Suzuki et al. ..... 430/24

4,070,596 1/1978 Tsuneta et al. ..... 313/408

*Primary Examiner*—José G. Dees

*Attorney, Agent, or Firm*—John C. Fox

[57] ABSTRACT

By adjusting the exposure dosages for the three primary color phosphors in the photolithographic process used to produce color CRTs for color television, standard whites of desired color temperatures are obtained. The aperture mask used in the photolithographic process is then discarded, and the CRT is operated as a monochrome tube in a standard receiver. Stable, rugged and portable color references are thus produced.

7 Claims, 3 Drawing Sheets

MONOCHROME CATHODE RAY TUBE FOR USE AS A COLOR REFERENCE

This is a division of application Ser. No. 719,616, filed Apr. 3, 1985, now U.S. Pat. No. 4,607,188.

BACKGROUND OF THE INVENTION

This invention relates to color references, and more particularly relates to monochrome cathode ray tubes (CRTs) as color references, and to a method for producing them.

All colorimetric instruments require calibration against a standard source prior to use. The National Bureau of Standards specifies incandescent lamps as primary sources for such calibration. Arbitrary colors can be achieved through the use of complex filter sets, and stability of the colors can be achieved through the extremely accurate control of the input energy (current and voltage).

However, away from the research laboratory, less costly and cumbersome standards (sometimes called secondary standards) are required. For example, in the manufacturing environment, successful quality control of color requires color standards which are stable, rugged, portable and relatively inexpensive.

A standard color television receiver or test set can be relatively easily adjusted to give an arbitrary color within its color gamut. However, the stability of the color is dependent upon a number of factors, including: registration between the three (red, blue and green) electron guns, the aperture mask and the phosphor pattern on the screen; the relative beam currents in each of the electron guns; and the operating (anode) voltage.

One solution to this problem is to eliminate two of the electron guns, the aperture mask and the phosphor pattern, and to produce the desired color standard by physically mixing different phosphors and depositing the resulting blend on the CRT screen. See, for example, U.S. Pat. No. 4,406,971. However, such tubes have been found to be difficult to produce, due primarily to the different physical characteristics of the phosphor powders. For example, when depositing the phosphor mixture by settling from a slurry, different settling rates, as well as packing anomalies, cause a shift in color of the settled deposit from that of the original blend. Thus, considerable trial and error is required to achieve a particular color standard.

Accordingly, it is an object of the invention to produce a color standard which is stable, rugged, portable and relatively inexpensive.

It is also an object of the invention to produce a color standard which uses CRT phosphors but does not depend on the use of phosphor blends.

It is also an object of the invention to produce a color standard from CRT phosphors which is nearly independent of registration and electrical factors.

SUMMARY OF THE INVENTION

In accordance with the invention, a monochrome cathode ray tube (CRT) for use as a color reference comprises an electron gun and a screen having at least one field of a patterned array of phosphor elements of at least two alternating colors, the sizes of the elements being constant for each color, and the relative sizes of the different color elements being predetermined to result in a standard color when the array is scanned by an electron beam from the gun of predetermined beam current and anode voltage.

In a preferred embodiment, an array of three alternating red, blue and green phosphors is used to obtain a standard color within their color gamut, and the array is located with three other arrays on the screen of a CRT, each of the three other arrays consisting of only one of the primary colors in the first array.

Also in accordance with the invention, a method is provided for producing the phosphor arrays, the method comprising photolithographically disposing at least one array of discrete phosphor elements of at least two alternating colors on a CRT face panel, by exposing a first layer of a first phosphor and photoresist to a source of actinic radiation from a first location through a patterned aperture mask, and developing the exposed layer to form a pattern of first phosphor elements, disposing a second layer of a second phosphor and photoresist over the pattern of the first phosphor elements, and then exposing the second layer to a source of actinic radiation from a second location through the aperture mask, and developing the second layer to form a pattern of second phosphor elements between the first phosphor elements, the sizes of the elements being related to the length of exposure and being constant for each color, the length of exposure being determined to obtain relative sizes of the elements to result in a desired color.

According to a preferred embodiment, an array of three alternating red, blue and green phosphor elements is produced by successively carrying out three such photolithographic forming steps.

According to another preferred embodiment, the aperture mask is substantially completely filled with apertures, and a plurality of fields, each having a different standard color array, are successively produced by first masking the apertures, and then successively unmasking the apertures in the areas defining the field to be produced, and repeating the photolithographic process for each unmasked area.

According to still another preferred embodiment, the aperture mask is substantially completely filled with apertures and a plurality of fields, at least one of which is an array of only one color, the color also being present in at least one other color array, are produced by first masking the apertures, and then unmasking the apertures in those areas defining the fields containing the same color, carrying out the photolithographic process for these unmasked areas, then masking the one color field and continuing the process for the unmasked area.

DESCRIPTION OF THE PREFERRED EMBODIMENTS

Figure 1:
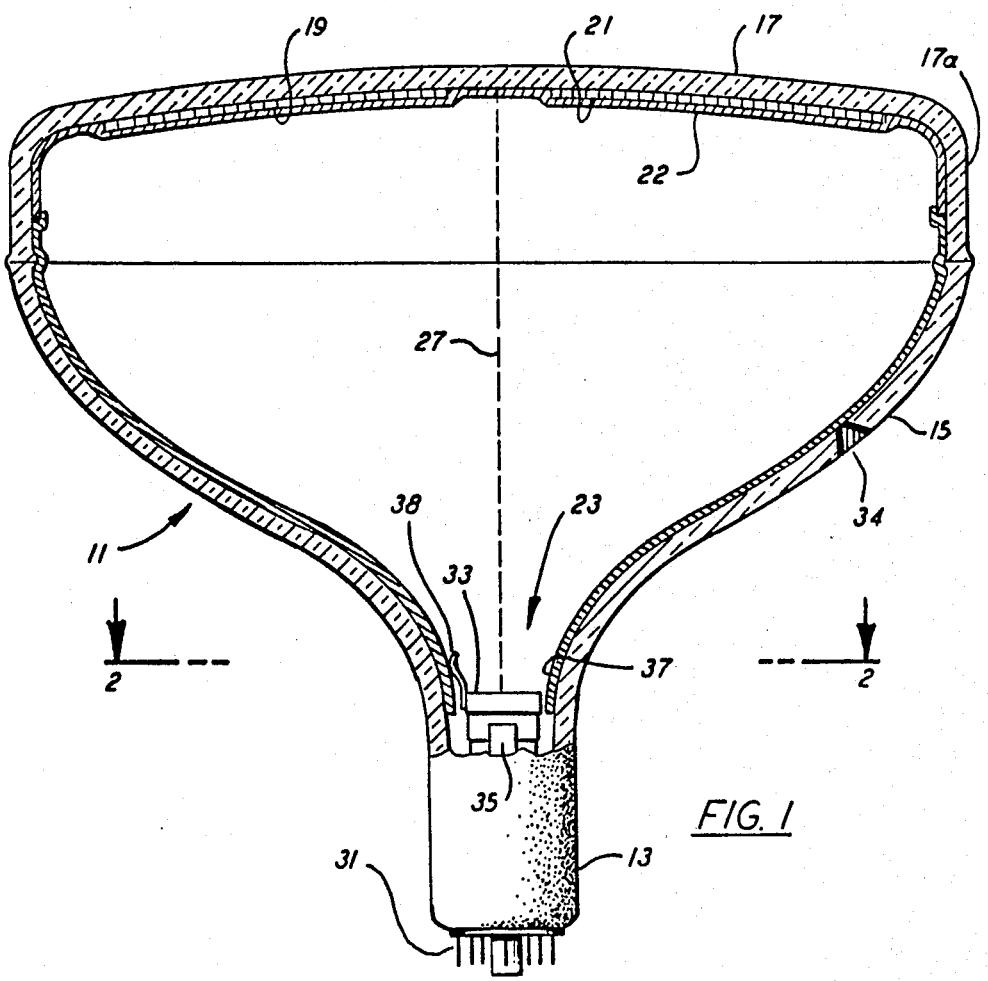
FIG. 1 is a top view, partly in section, of a cathode ray tube (CRT) of the invention having a screen of standard color fields.

Referring now to FIG. 1, there is shown a CRT 11 comprising an outer glass envelope having integrated neck 13, funnel 15 and face panel 17 portions, a screen composed of a plurality of color reference fields (19 and 21 are shown) disposed on the interior surface of the face panel 17, conductive coating 22 overlying the fields 19 and 21 and extending partially down the sidewall 17*a* of panel 17, conductive coating 37 partially overlapping coating 22 and extending across the interior surface of the funnel 15 and partially into the neck 13, electron gun assembly 23 located in the neck 13, the assembly terminating in convergence cup 33 and including at least one snubber 38 connected to the cup for making electrical contact with coating 37.

In operation, an operating or anode voltage is applied to the screen and terminal portion of the gun assembly through anode button 34, and various smaller voltages are applied to the gun assembly through pin connectors 31, resulting in at least one electron beam 27 being directed toward the screen. Associated deflection coils and control circuitry, not shown, cause the beam to scan the screen in a known manner. CRT phosphors in the color reference fields are thus excited to produce luminescent emissions of predetermined colors. Such colors are stable and reproducible, for given values of anode voltage and beam current.

Figure 2:
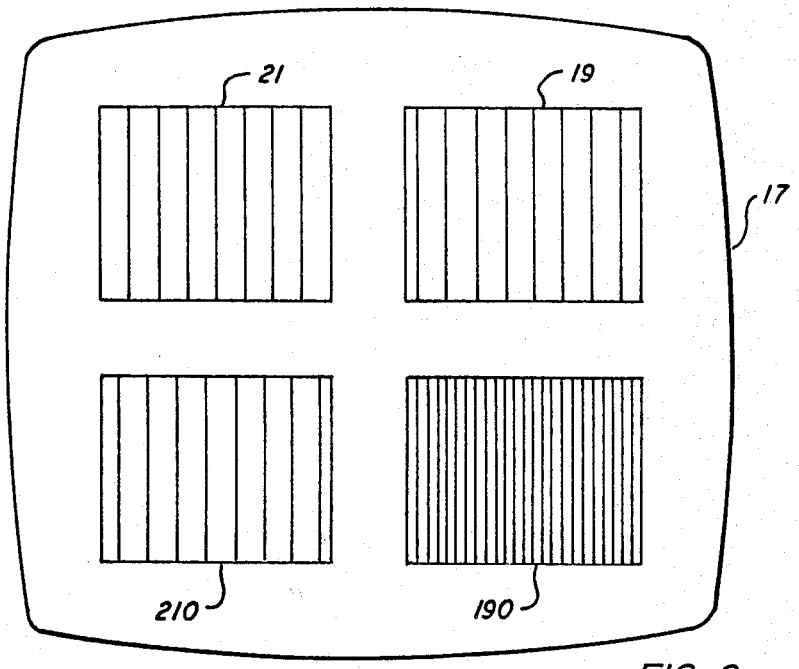
FIG. 2 is a front elevation view of the CRT of FIG. 1 showing four standard color fields.

FIG. 2 is a front view of the panel 17 of FIG. 1, showing four color reference fields 21, 19, 190 and 210. These are each composed of vertically oriented stripes of phosphor material. Field 190 is composed of an array of alternating red, blue and green stripes, while fields 21, 19 and 210 are each composed of only one of these three primary colors. The relative widths of the red, blue and green stripes in field 190 are chosen to give a desired color within the color gamut of these primary colors, for example, a white having a particular color temperature. The remaining fields in this embodiment simply provide the primary colors, although any one or more of them could be composed of two or more phosphors to provide additional whites of different color temperatures or other standard colors.

Figure 3:
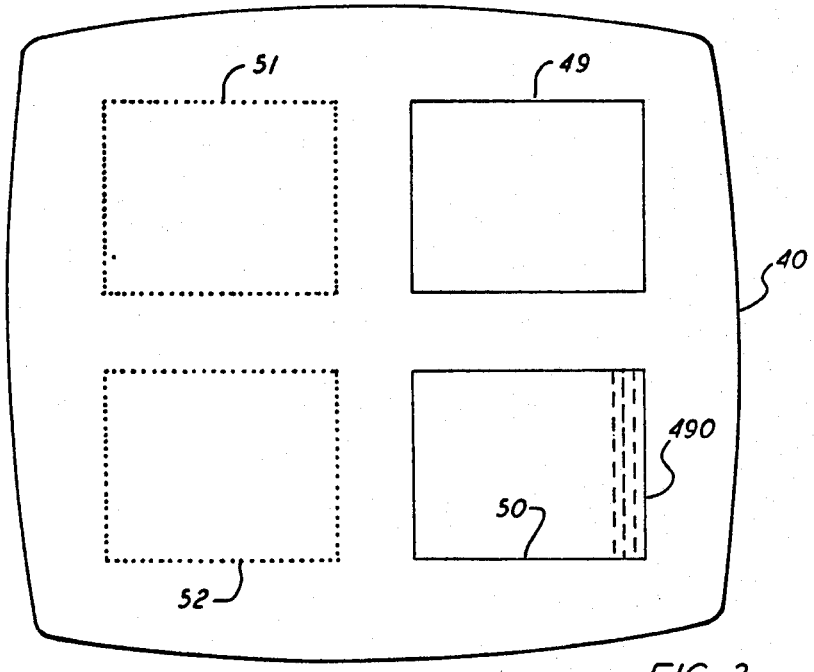
FIG. 3 is a front elevation view of an aperture mask suitable for use in the method of the invention.
Figure 5A:
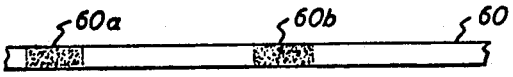
FIGS. 5 (*a*) through (*l*) are diagrams representing the steps of the photolithographic process used to produce color reference fields according to a preferred embodiment of the invention.
Figure 5B:
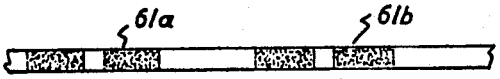
Figure 5C:
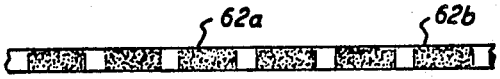
Figure 5D:
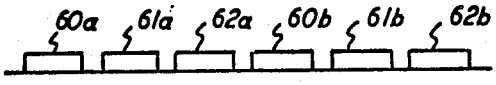
Figure 5E:
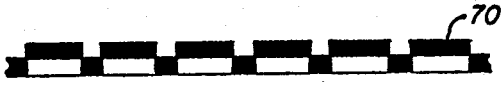
Figure 5F:
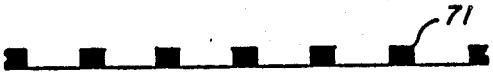
Figure 5G:
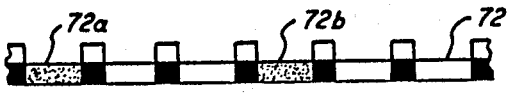
Figure 5H:
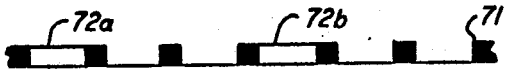
Figure 5I:
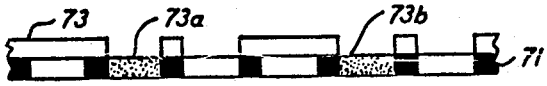
Figure 5J:
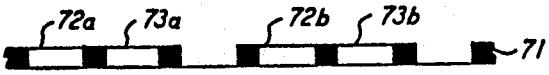
Figure 5K:
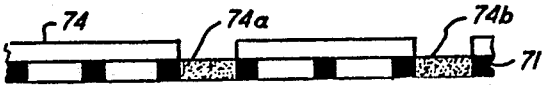
Figure 5L:
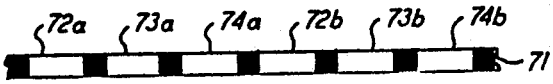

The spacings between the phosphor stripes in the monochrome fields 21, 19 and 210 are wider than those in field 190 because the stripes are all formed photolithographically through a single aperture mask of the type used in color CRTs for color television. Such a mask is shown in FIG. 3.

In this embodiment, the apertures 490 in the mask 40 are elongated in the vertical direction, are arranged in vertical columns, and are spaced from one another in such columns by a distance less than the width of the apertures. A second mask 41 overlying mask 40 defines two of the four fields to be formed on the screen, by means of large apertures 49 and 50. The positions of the other field apertures are indicated in phantom at 51 and 52.

Figure 4:
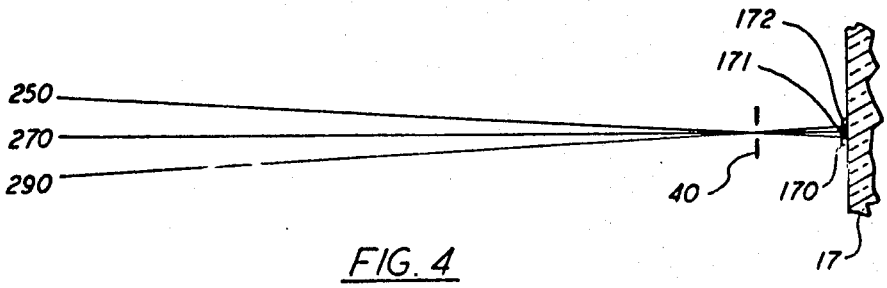
FIG. 4 is a diagram representing ray traces from an actinic source through an aperture mask to a screen.

In the photolithographic process employed, an aqueous photoresist material, such as polyvinyl alcohol sensitized with a dichromate, which becomes insoluble in water upon exposure to a source of actinic radiation such as a light, is exposed through a patterned mask, and then developed by washing with water to remove the unexposed portions and leave the exposed pattern. By employing an elongated light source having a length several times that of a single aperture, the shadows cast by the bridges of mask material between the vertically adjacent apertures are almost completely eliminated, resulting in a pattern of continuous vertical stripes when using the mask of FIG. 3. In addition, by making multiple exposure, a single aperture row can result in multiple stripes. This is illustrated in FIG. 4 in which movement of the light source to three different locations, indicated by the three ray traces 250, 270 and 290, results in three different stripes 170, 171 and 172, through a single aperture row 490*a* in mask 40. This process is similar to that used in the production of color CRTs for color television. See, for example, U.S. Pat. Nos. 3,140,176; 3,146,368; and 4,070,596.

As is known, color screens for color CRTs can be made either with or without a light-absorbing matrix surrounding the phosphor elements. Such a matrix is generally thought to improve contrast and/or brightness of the image display. In the formation of color references in accordance with the invention, such a matrix may be advantageous in that it enables less precise control over the photolithographic process for formation of the phosphor arrays. This is because the luminance of the primary phosphor colors is controlled by adjusting the sizes of the windows in the matrix, which windows define the sizes of the phosphor elements. Window size is controlled by the dosage (intensity times time) of exposure of the photoresist used to form the matrix. In a nonmatrix color reference, the luminance of the primary colors is controlled by the dosage of exposure of the photoresist used to form the phosphor array for that color.

In both the matrix and the non-matrix cases, the relationship between dosage and luminance of a phosphor element can be approximated by the empirical linear relationship $$L=A\times D+B \qquad (1)$$

where A and B are constants.

Referring now to FIG. 5, the screen is depicted during the various steps of a preferred embodiment of the photolithographic process in which prior to the formation of the phosphor array, a light-absorbing matrix is first formed by successively exposing a single photoresist layer 60 to a source of actinic radiation from three different locations through the mask, [FIGS. 5(*a*), 5(*b*) and 5(*c*)] to result in insolubilized portions 6O*a* and 60*b*, 6l*a* and 6l*b*, and 62*a* and 62*b*. The exposed resist is then developed to remove the unexposed portions and leave an array of photoresist elements corresponding to the contemplated phosphor pattern array [FIG. 5(*d*)]. Next, a light-absorbing layer 70 is disposed over the array, [FIG. 5(*e*)], and the composite layer is developed to remove the photoresist array and overlying light-absorbing layer, leaving a matrix 71 defining an array of windows corresponding to the contemplated phosphor pattern array. [FIG. 5(*f*)]. Because the exposed resist is insoluble in water, a special developer is required for this step, such as hydrogen peroxide or potassium periodate, as is known. By adjusting the dosages of actinic radiation during each exposure in steps 5(*a*) through (*c*), windows of the desired size for each phosphor color can be produced.

By way of example, assume three phosphors (red, blue and green) having color coordinates of x(r), y(r); x(b), y(b); and x(g), y(g), respectively, are to be used to produce a color standard having color coordinates of x(s), y(s) and a luminance of L(s). The following set of linear equations describe the desired relationships:

$$x(s)=[x(r)L(r)+x(g)L(g)+x(b)L(b)]/L(s) \quad (2)$$

$$y(s)=[y(r)L(r)+y(g)L(g)+y(b)L(b)]/L(s) \quad (3)$$

$$L(s)=L(r)+L(g)+L(b) \quad (4)$$

This set may be inverted to determine the red, green and blue luminances required to produce the standard color. Equation (1) is then inverted to determine the dosages required to produce the desired relative window sizes.

Next, phosphor layers are formed over the windows as follows. First, a layer of a red phosphor and photoresist 72 is disposed over the matrix layer 71 and exposed [FIG. 5(*g*)], and developed to result in red elements 72*a* and 72*b* [FIG. 5(*h*)]. This procedure is then repeated for the blue and green phosphors [FIGS. 5(*i*) through (*l*)] to result in the phosphor array having alternating red (72*a* and *b*), blue (73*a* and *b*), and green (74*a* and *b*) stripes. Because equation (1) is only an approximation based on experimentation, and because of certain nonlinearities in the photolithographic process, the achievement of color standards of the desired color coordinates will normally require the production of several test panels to determine the correct exposure times. Preferably, each color is bracketed, that is, an exposure is also made above and below the calculated exposure for each color, while keeping the other exposure times constant. Thus, where three colors are used, nine test panels would be prepared by the above procedure. These test panels are then measured with a calibrated spectraradiometer to determine their actual color and spectrum.

By way of example, white color standards have been produced having x and y color coordinates of 0.2991 and 0.3138 and a color temperature of 7513° K+7 MPCD's, using standard color CRT red, blue and green phosphors having x and y coordinates of 0.6374 and 0.3524, 0.1472 and 0.0664, and 0.3368 and 0.5984, respectively. These standards have been run on a single gun in a standard receiver at operating voltages of 25 kilovolts and beam currents of 333 microamps. These standards exhibit a luminance of about 98.5 foot lamberts over an approximately 4 inch square area. Because of the nonlinearity of the green phosphor luminance with current, these current and voltage values should be maintained within plus or minus 5 to 10 percent in order to maintain the x and y values of the desired color within plus or minus 0.0002.

By comparison, the operating conditions for an incandescent lamp standard must be controlled within about one-half to one percent in order to maintain comparable colorimetric accuracy. In addition, due primarily to the fragility of the incandescent filament, such a standard is not as durable as a CRT standard. Due to the inherent mechanical and chemical stability of the screen, the color standard remains constant over the relatively long life of the CRT.

These CRTs can also be used as luminance standards, and when the operating (anode) voltage, beam current and size of the raster scan are controlled to within plus or minus a tenth of a percent, have accuracies of about one-half percent, versus 3 percent for incandescent standards under comparable degrees of control.

What is claimed is:

1. A method for producing a monochrome cathode ray tube for use as a color standard, the tube comprising an evacuated glass envelope having integrated face panel, funnel and neck portions, a phosphor screen disposed on the interior surface of the face panel, and an electron gun located in the neck, the gun having a plurality of electrodes including a thermal anode, for forming and directing one or more electron beams onto the screen to excite the phosphor, a conductive coating on the interior surface of the screen, and a conductive coating on the interior surface of the envelope for interconnecting the screen coating and the anode, the method comprising:

photolithographically disposing at least one field of a repetitive patterned array of discrete phosphor elements of at least two alternating colors on the interior surface of the face panel, by exposing a first layer of a first phosphor and photoresist to a source of actinic radiation from a first location through a patterned aperture mask positioned in spaced relationship to the layer and having an aperture pattern which substantially completely fills the mask, the apertures approximately the size of the desired phosphor elements, and developing the exposed layer to form a pattern of first phosphor elements, disposing a second layer of a second phosphor and photoresist over the pattern of first phosphor elements, and then exposing the second layer to a source of actinic radiation from a second location through the aperture mask, and developing the exposed layer to form a pattern of second phosphor elements between the first phosphor elements, the sizes of the elements being related to the length of exposure and being constant for each color, the length of each exposure being predetermined to produce relative sizes of the different color elements to result in a standard color when the array is scanned by an electron beam from the electron gun of predetermined beam current and anode voltage, characterized in that a plurality of fields, each having a different standard color array, are successively produced on the face panel by first masking the apertures, and then successively unmasking the apertures in those areas of the aperture mask defining one field to be produced, and repeating the photolithograhic process for each unmasked area.

2. A method for producing a monochrome cathode ray tube for use as a color standard, the tube comprising an evacuated glass envelope having integrated face panel, funnel and neck portions, a phosphor screen disposed on the interior surface of the face panel, and an electron gun located in the neck, the gun having a plurality of electrodes including a thermal anode, for forming and directing one or more electron beams onto the screen to excite the phosphor, a conductive coating on the interior surface of the screen, and a conductive coating on the interior surface of the envelope for interconnecting the screen coating and the anode, the method comprising:

photolithographically disposing at least one field of a repetitive patterned array of discrete phosphor elements of at least two alternating colors on the interior surface of the face panel, by exposing a first layer of a first phosphor and photoresist to a source of actinic radiation from a first location through a patterned aperture mask positioned in spaced relationship to the layer and having an aperture pattern which substantially completely fills the mask, the apertures approximately the size of the desired phosphor elements, and developing the exposed layer to form a pattern of first phosphor elements, disposing a second layer of a second phosphor and photoresist over the pattern of first phosphor elements, and then exposing the second layer to a source of actinic radiation from a second location through the aperture mask, and developing the exposed layer to form a pattern of second phosphor elements between the first phosphor elements, the sizes of the elements being related to the length of exposure and being constant for each color, the length of each exposure being predetermined to produce relative sizes of the different color elements to result in a standard color when the array is scanned by an electron beam from the electron gun of predetermined beam current and anode voltage, characterized in that a plurality of fields at least one of which is an array of phosphor elements of only one color, the color also being present in at least one other color array, are produced on the face panel by first masking the apertures, and then unmasking the apertures in those areas of the aperture mask defining the fields containing the same color, carrying out the photolithographic process for these unmasked areas for the same color, then masking the one color field area and continuing the photolithographic process for any remaining colors of the unmasked array.

3. The method of claim 1 or 2 in which following development to form the pattern of second phosphor elements, a third layer of a third phosphor and photoresist is formed over the pattern of first and second phosphor elements, the third layer is exposed to a source of actinic radiation from a third location through the mask, and the exposed layer is developed to form a pattern of third phosphor elements between the first and second phosphor elements.

4. The method of claim 3 in which the colors of the phosphor elements are red, green and blue.

5. The method of claim 1 or 2 in which prior to the formation of the patterned array of phosphor elements, a light-absorbing matrix is first formed photolithographically on the interior surface of the face panel by successively exposing a single photoresist layer to a source of actinic radiation from said first and second locations through the mask, developing the exposed layer to remove the unexposed portions and leave an array of photoresist corresponding to the contemplated phosphor pattern array, disposing a light-absorbing layer over the photoresist array, and developing the light-absorbing layer to remove the exposed portions of the photoresist and overlying back layer, leaving a light-absorbing matrix, the matrix defining an array of windows corresponding to the contemplated phosphor pattern array.

6. The method of claim 1 or 2 in which the apertures in the mask are elongated in the vertical direction, are arranged in vertical columns, and are spaced from one another in such columns by a distance less than the width of the apertures, and in which the source of actinic radiation is elongated by an amount several times the length of a single aperture, and oriented vertically, whereby during exposure, the source tends to expose continuous vertical stripes corresponding to the vertical aperture columns.

7. The method of claim 2 in which the screen comprises four fields, a first field of an array of red, green and blue phosphor elements, a second field of red phosphor elements, a third field of green elements and a fourth field of blue elements, and in which the screen is produced by carrying out the photolithographic process for each color while the remaining one color field areas are masked.

* * * * *